US007784961B1

(12) United States Patent
Rawlings

(10) Patent No.: US 7,784,961 B1
(45) Date of Patent: Aug. 31, 2010

(54) CLIP-ATTACHABLE LIGHT STRINGS FOR CHRISTMAS TREE BRANCHES

(76) Inventor: April Rawlings, 4600 S. 3200 W., Weston, ID (US) 83286

( * ) Notice: Subject to any disclaimer, the term of this patent is extended or adjusted under 35 U.S.C. 154(b) by 0 days.

(21) Appl. No.: 12/284,960

(22) Filed: Sep. 26, 2008

(51) Int. Cl.
*F21V 33/00* (2006.01)

(52) U.S. Cl. ..... 362/123; 362/249.19; 362/396

(58) Field of Classification Search ..... 362/122, 362/123, 249.14, 249.18, 249.19, 249.06, 362/249.16, 396
See application file for complete search history.

(56) References Cited

U.S. PATENT DOCUMENTS

| | | | | |
|---|---|---|---|---|
| 1,895,656 | A | 1/1933 | Gadke | |
| 2,782,296 | A * | 2/1957 | Walter | 362/392 |
| 3,019,357 | A | 1/1962 | Zaffina | |
| 3,193,229 | A | 7/1965 | Stock | |
| 4,462,065 | A | 7/1984 | Rhodes | |
| D298,738 | S | 11/1988 | Rumpel | |
| 5,245,519 | A | 9/1993 | Openiano | |
| D355,625 | S * | 2/1995 | Blahowski | D8/1 |
| 5,575,446 | A | 11/1996 | Swenson et al. | |
| 5,700,081 | A * | 12/1997 | Mengle et al. | 362/123 |
| 5,772,166 | A | 6/1998 | Adams | |
| 5,848,493 | A * | 12/1998 | Gasper | 47/41.15 |
| 2003/0147236 | A1 * | 8/2003 | Chang | 362/123 |
| 2004/0012950 | A1 * | 1/2004 | Pan | 362/123 |

* cited by examiner

*Primary Examiner*—Laura Tso
(74) *Attorney, Agent, or Firm*—Montgomery Patent and Design; Robert C. Montgomery; Joseph T. Yaksich

(57) ABSTRACT

A decorative Christmas tree lighting system with individual light strands for each tree bough or branch is herein disclosed, comprising a central bus wire located near the trunk of the tree and a series of five (5) to ten (10) single-ended lighting strands originating in an outward or radial pattern therefrom the central bus wire. Each of these lighting "branch" strands has approximately ten (10) to twenty (20) individual light bulbs, depending on the overall size, and is routed along or around an individual branch or bough of the tree. Each individual light strand is held in place with at least two (2) clip means, one (1) near the outer end of the branch, and one (1) near the tree trunk, which help hold the lights in place. The central bus wire comprises a plurality of electrical plugs on each end to allow for end-to-end connection of multiple light systems. In such a manner, any size tree can be illuminated by simply adding additional light systems.

16 Claims, 5 Drawing Sheets

CLIP-ATTACHABLE LIGHT STRINGS FOR CHRISTMAS TREE BRANCHES

RELATED APPLICATIONS

The present invention was first described in a notarized Official Record of Invention on Oct. 16, 2007, that is on file at the offices of Montgomery Patent and Design, LLC, the entire disclosures of which are incorporated herein by reference.

FIELD OF THE INVENTION

The present invention relates generally to a decorative Christmas tree lighting system and, more particularly, to said lighting system comprising a central bus wire located near the trunk of the tree and a series of five (5) to ten (10) single-ended individual light strands originating in an outward or radial pattern therefrom the central bus wire, each individual light strand comprises approximately ten (10) to twenty (20) individual light bulbs and is routed along or around an individual branch or bough of the tree, and each individual light strand is held in place with at least two (2) clip means, one (1) near the outer end of the branch, and one (1) near the tree trunk.

BACKGROUND OF THE INVENTION

The holiday season is a time of great fun and happiness and a great deal of the holiday cheer comes from the yearly traditions that are passed from generation to generation. Perhaps the most well known of all traditions is that of the Christmas tree. The act of putting it up and decorating it in one's home is a process that can be enjoyed by all members of the family. A decorated tree with all of the ornaments, the garland, and the tinsel is the centerpiece of a home's holiday decorations. Lights are also used with Christmas trees, and while they add to the aesthetic quality of the tree, especially at night, they only cover the surface perimeter of the tree and do not emphasize the true beauty of each branch or bough. Additionally, daylight hours reveal the wiring that loops around the circumference of the tree which sticks out like a sore thumb in an unsightly manner. Much additional work is often required to help hide the wiring with the garland or strategically placed ornaments. Accordingly, there is a need for a means by which decorative holiday lights can be applied to any type of Christmas tree in a manner which addresses the above disadvantages. The development of the present invention fulfills this need.

The present invention is a Christmas tree decorative lighting system with individual light strings for each tree bough or branch. The invention uses a central bus wire located near the trunk of the tree. From this main cable, a series of five (5) to ten (10) single ended lighting circuits originate in an outward or radial pattern. Each of these lighting "branch" circuits have approximately ten (10) to twenty (20) individual lamps depending on the overall size of the invention. These individual light strands are then routed along or around an individual branch or bough of the tree. Each individual string is held in place with at least two (2) clips, one (1) near the outer end of the branch, and one (1) near the tree trunk, which help hold the lights in place. The main trunk wiring is provided with electrical plugs on each end to allow for end-to-end connection of multiple light systems. In such a manner, any size tree from a very small one, to a very large one, can be illuminated by simply adding additional light systems. The use of the present invention allows for the decoration of all types of Christmas trees in a more realistic manner which outlines each branch, rather than the conventional method which simply wraps the tree in a series of lights in a ring pattern.

Several attempts have been made in the past to provide Christmas light decorating systems. U.S. Pat. No. 5,575,446, issued in the name of Swenson et al., discloses a clamping device for attaching Christmas tree light wires and/or decorations to Christmas trees. The Swenson et al. device comprises open loop clamping devices having openings at respective opposite sides of each other for accepting branches and light string wires. However, unlike the present invention, the Swenson et al. device does not use at least two (2) claw-like clip attachment means and light strings that outline each individual Christmas tree branch for a more realistic decoration system.

U.S. Pat. No. 5,245,519, issued in the name of Openiano, discloses a Christmas light decorating system comprising one (1) or more clusters of flashing lights. However, unlike the present invention, the Openiano Christmas light decorating system does not use clip attachment means to attach individual light strings to Christmas tree branches in a more realistic manner where the individual light strings outline each of the Christmas tree branches.

U.S. Pat. No. 4,462,065, issued in the name of Rhodes, discloses an apparatus for decoratively lighting an outdoor tree. The Rhodes apparatus consists of a lighting system that is attachable to a trunk portion of a natural tree and provides a predetermined lighting pattern within a branch portion of said natural tree without physical attachment of the lighting system to the branch portion of the natural tree. However, unlike the present invention, the Rhodes apparatus is not for outlining individual branches of a Christmas tree and does not use clip attachment means for securing individual light strands to each individual branch of the Christmas tree.

Additionally, various ornamental designs for clips for Christmas lights have been provided, particularly, U.S. Pat. No. D298,738. However, none of these designs are similar to the present invention.

None of the prior art particularly describes a Christmas tree lighting system comprising a central bus wire located near the trunk of the tree and a series of five (5) to ten (10) single-ended individual light strands originating in an outward or radial pattern therefrom the central bus wire, each individual light strand comprises approximately ten (10) to twenty (20) individual light bulbs and is routed along or around an individual branch or bough of the tree, and each individual light strand is held in place with at least two (2) clip means, one (1) near the outer end of the branch, and one (1) near the tree trunk that the instant invention possesses. Accordingly, there exists a need for a means by which decorative holiday lights can be applied to any type of Christmas tree in a manner that operates without the disadvantages as described above.

SUMMARY OF THE INVENTION

In view of the foregoing disadvantages inherent in the prior art, it has been observed that there is need for a Christmas tree lighting system that uses at least two (2) clip attachment means to secure individual light strands to an outline of each individual branch of a Christmas tree in a more realistic manner.

To achieve the above objectives, it is an object of the present invention to provide an attachable light string device for tree branches comprising a central bus wire comprising an electrical plug on each end to allow for connection of multiple light string devices theretogether and providing power to each device.

A further object of the present invention is said device to further comprise a plurality of individual light strands each connected to the central bus wire, each comprising a plurality of light bulbs arranged to outline the tree branches, a plurality of electrical wiring connecting the plurality of light bulbs to the central bus wire, and at least one (1) clip attachment means to secure the plurality of individual light strands thereto the tree branches, wherein the device decorates all types of the tree branches in a more realistic manner by outlining each of the tree branches and wherein the device is capable of completely covering any size tree by interconnecting as many of the light string devices as needed.

Another object of the present invention is the clip attachment means comprising a claw-like clip or a similar clip.

Yet another object of the present invention is having a first clip attachment means located adjacent thereto an outer end of each of the individual light strands and a second clip attachment means located adjacent thereto an inner end of each of the individual light strands.

Still yet another object of the present invention is having the device comprise approximately five (5) to ten (10) individual light strands.

Still yet another object of the present invention is having each of the plurality of individual light strands have approximately ten (10) to twenty (20) light bulbs.

Yet still another object of the present invention is having the plurality of electrical wiring green or white.

Still another object of the present invention is having the plurality of light bulbs light-emitting diodes.

Still yet another object of the present invention is having the plurality of light bulbs available in a variety of shapes, sizes, and colors.

Yet another object of the present invention is having the plurality of light bulbs special effect lights that flash on and off.

Still another object of the present invention is having the plurality of individual light strands available in a variety of lengths to accommodate different sized trees.

Yet another object of the present invention is having the electrical plug a male and female electrical plug.

Still yet another object of the present invention is having the electrical plug at one (1) end plugged into a wall outlet to provide electrical power to the device.

Yet another object of the present invention is having each of the individual light strands further comprise a vertical light bulb located at an outer end wherein an ornament can sit on top of the vertical light bulb and be illuminated.

Another object of the present invention is a method for using an attachable light string device for tree branches.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 2:
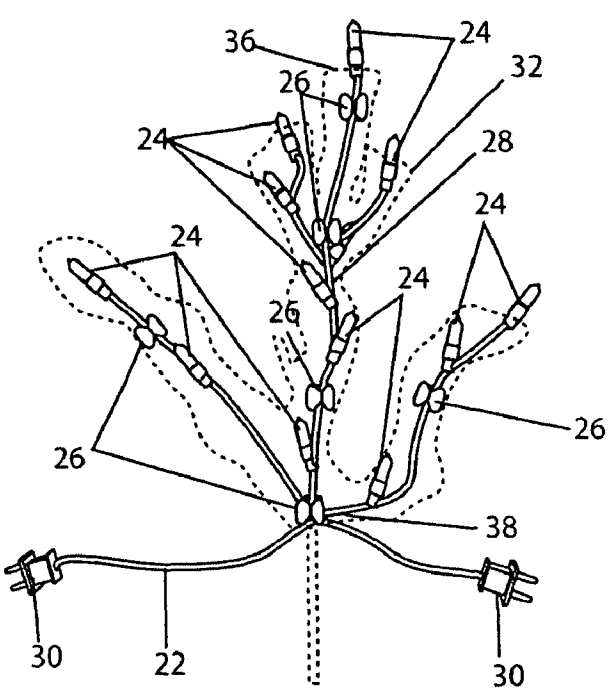
FIG. 2 is a top perspective view of a of a clip-attachable light string for Christmas tree branch 10 attached to a tree branch 32 by a clip means 26, according to a preferred embodiment of the present invention.

10 clip-attachable light string for Christmas tree branches
20 individual light strand
22 central bus wire
24 light bulb
26 clip attachment means
28 electrical wiring
30 electrical plug
32 tree branch
34 vertical light bulb
36 outer end
38 inner end

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a clip-attachable light string for Christmas tree branches 10 (herein described as the "device") 10, which provides a tree decorative lighting system with a plurality of individual light strands 20 for a tree bough or branch 32 is herein disclosed. Each of the individual light strands 20 have approximately a plurality of ten (10) to twenty (20) light bulbs 24 depending on the overall size of the tree. The individual light strands 20 are then routed along or around the individual tree branches 32. Furthermore, each of the individual light strands 20 are held to the tree branch 32 with at least two (2) of a clip attachment means 26. The clip attachment means 26 hold the individual light strands 20 securely to the tree branch 32. The use of the device 10 allows for the decoration of all types of Christmas trees in a more realistic manner which outlines each of the tree branches 32, rather than the conventional method which simply wraps the tree in a series of lights in a ring pattern.

Figure 1:
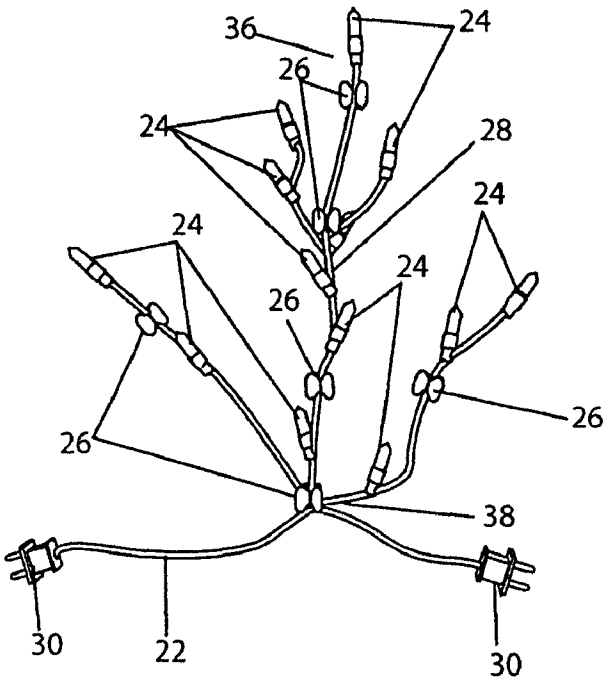
FIG. 1 is a top perspective view of a clip-attachable light string for Christmas tree branch 10, according to a preferred embodiment of the present invention.

Referring now to FIG. 1, a top perspective view of the device 10, according to the preferred embodiment of the present invention, is disclosed. The device 10 uses a central bus wire 22, located near the trunk of a tree, and from this main cable a series of approximately five (5) to ten (10) of the individual light strands 20 originate in an outward or radial pattern from the tree. The central bus wire 22 is routed along the tree trunk and provides power to each of the individual light strands 20 through an electrical wiring 28 system. Also, the central bus wire 22 is provided with an electrical plug 30 on each end to interconnect more of the devices 10 together. In this manner, the device 10 is capable of completely covering any size tree because as many of the devices 10 as needed can be connected until a tree is completely covered, thereby establishing electrical communication therebetween multiple devices 10.

Each of the individual light strands 20 have approximately ten (10) to twenty (20) of the light bulbs 24 depending on the overall size of the tree. The light bulbs 24 are connected by the electrical wiring 28 system. The system of electrical wiring 28 for each of the individual light strands 20 are connected to the central bus wire 22. Also, the electrical wiring 28 will be available in green and white colors so the wire will match the color of the natural or flocked Christmas trees. The light bulbs 24 are preferably, but not limited to, light-emitting diodes because they are more efficient then incandescent bulbs. The individual light strands 20 would be made in a manner identical to that used to manufacture conventional Christmas tree lights.

The individual light strands 20 are then routed along or around the individual tree branches 32. In this manner, the light bulbs 24 outline the tree branch 32 for a more realistic looking lighting system. The light bulbs 24 can come in a variety of shapes, sizes, and colors to allow a user to customize the look of their Christmas tree lighting system. Also, special effect lights could be used to allow the lights to flash on and off to music. The individual light strands 20 will be available in a variety of lengths to accommodate different sized trees. Also, a user can choose the shortest individual light strands 20 for the upper portion of a tree and the longest individual light strands 20 for the lower portion of a tree. Furthermore, each individual light strand 20 is held to the tree branch 32 with the clip attachment means 26. Preferably, the first clip attachment means 26 is located adjacent thereto the outer end 36 of the tree branch 32 and the second clip attachment means 26 is located adjacent thereto the inner end 38 of the tree branch 32. Additional clip attachment means 26 can be used as needed to further secure the individual light strands 20 to the tree branches 32. The clip attachment means 26 are pre-attached to the electrical wiring 28. The clip attachment means 26 hold the individual light strands 20 securely to the tree branch 32 and allow the device 10 to be easily applied and removed from the tree. The clip attachment means 26 are preferably claw-like clips or the like.

The central bus wire 22 is provided with the electrical plugs 30 on each end to allow for end-to-end connection of any number of the devices 10. The electrical plugs 30 preferably will be male and female electrical plugs 30. In such a manner, any size tree from a very small one, to a very large one, can be illuminated by simply connecting additional devices 10. One of the electrical plugs 30 at the end of the central bus wire 22 is plugged into a wall outlet to provide electrical power to the device 10. The device 10 allows for a Christmas tree lighting system that outlines and lights each of the major tree branches 32 allowing for a more attractive and realistic tree illumination. Also, the device 10 avoids the ringed or draped look common with conventional Christmas tree lighting systems and the device 10 can be used over and over again. Furthermore, the device 10 can be used on both real and artificial trees, indoor or outdoor, in residential or commercial lighting displays, and also can be used on bushes, hardwood trees, or other outdoor applications.

Referring now to FIG. 2, a top perspective view of the device 10 attached to the tree branch 32 by the clip attachment means 26, according to the preferred embodiment of the present invention, is disclosed. The individual light strand 20 is secured to the tree branch 32 by the clip attachment means 26. The first clip attachment means 26 is used adjacent thereto the outer end 36 of the tree branch 32 and the second clip attachment means 26 is used adjacent thereto the inner end 38 of the tree branch 32. Additional clip attachment means 26 can be added, as needed, to further secure the individual light strands 20 to the tree branches 32. This allows for a Christmas lighting system that illuminates the outline of each tree branch 32 and provides for a more realistic and attractive decorated Christmas tree.

Figure 3:
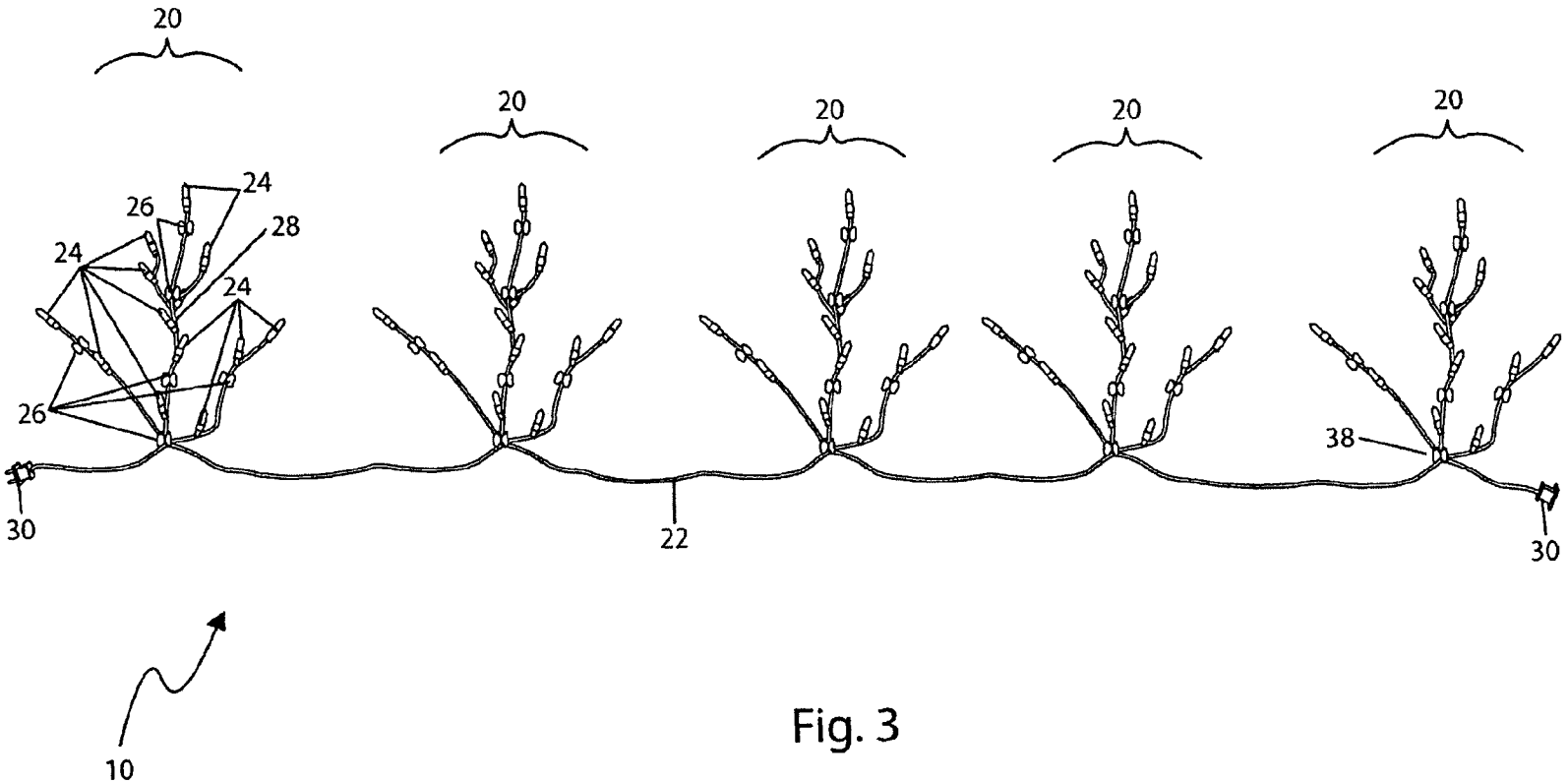
FIG. 3 is a top view of a clip-attachable light string for Christmas tree branch 10 having a plurality of individual light strands 20 connected by a central bus wire 22 and having an electrical plug 30 on each end for connecting another clip-attachable light string for Christmas tree branch 10 thereto, according to a preferred embodiment of the present invention.

Referring now to FIG. 3, a top view of the device 10 having the individual light strands 20 connected by the central bus wire 22 and having the electrical plugs 30 on each end for connecting another device 10 thereto, according to the preferred embodiment of the present invention, is disclosed. The central bus wire 22 connects the series of individual light strands 20. The ends of the central bus wire 22 have the electrical plugs 30 which allow for as many of the devices 10 to be interconnected together so any size tree can be completely illuminated.

Figure 4:
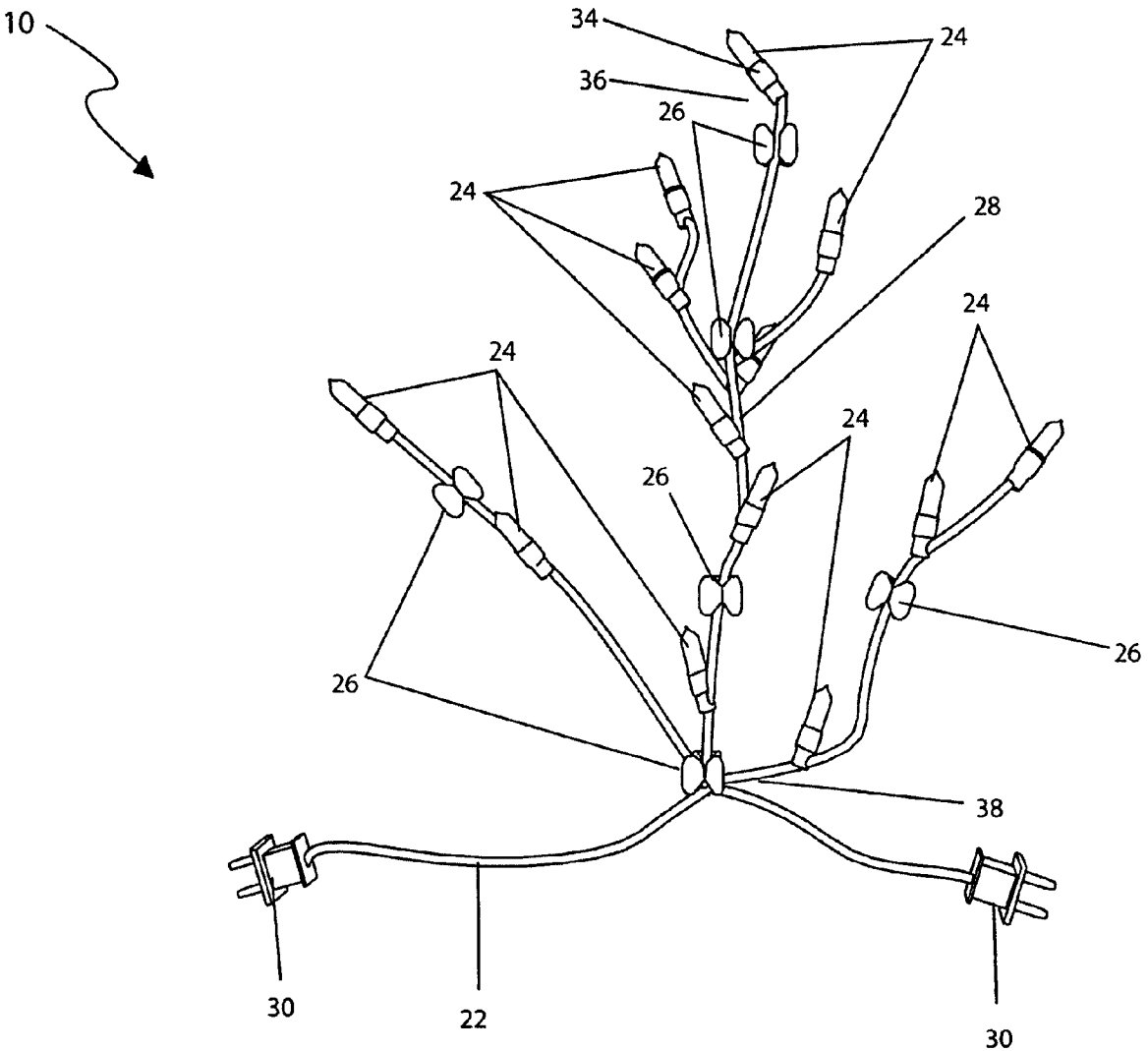
FIG. 4 is a top perspective view of a clip-attachable light string for Christmas tree branch 10 having a vertical light bulb 34, according to a preferred embodiment of the present invention.

Referring now to FIG. 4, a top perspective view of the device 10 having a vertical light bulb 34, according to the preferred embodiment of the present invention, is disclosed. The device 10 has the vertical light bulb 34 located at the outer end 36 so that a non-hanging ornament can sit on top of the light and be illuminated.

Figure 5A:
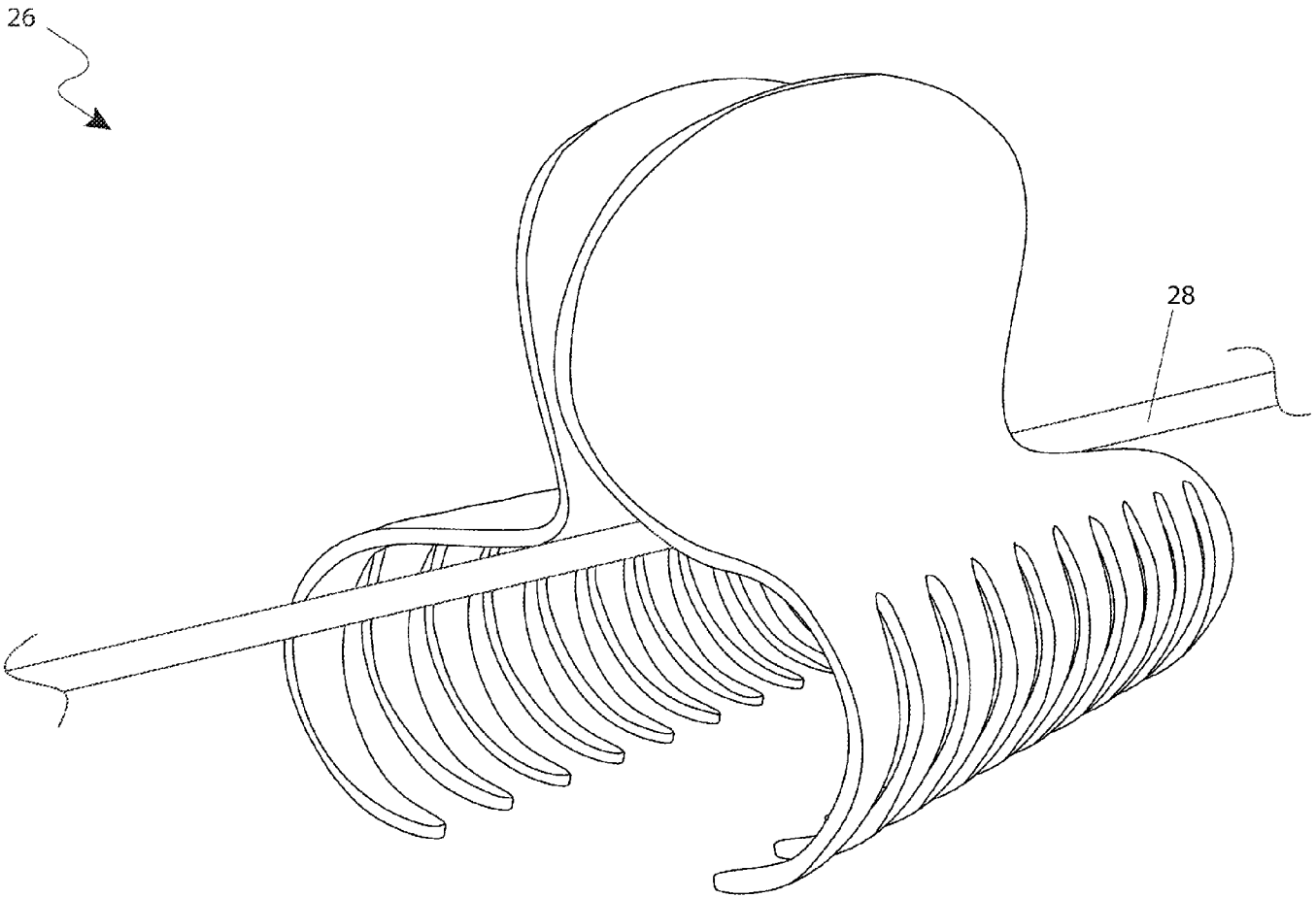
FIG. 5*a* is a side perspective view of a clip attachment means 26, according to a preferred embodiment of the present invention; and, FIG. 5*b* is a bottom perspective view of a clip attachment means 26, according to a preferred embodiment of the present invention.
Figure 5B:
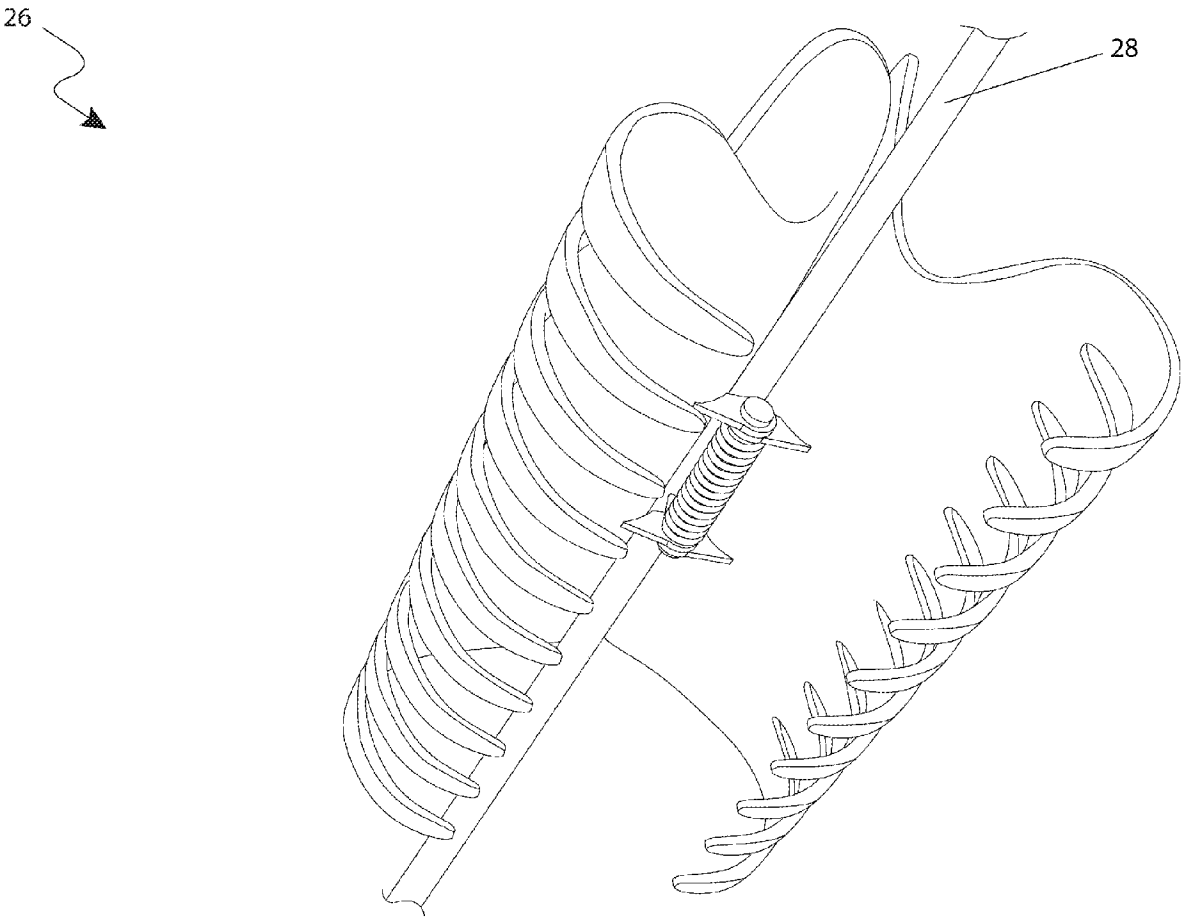

Referring now to FIGS. 5*a* and 5*b*, side and bottom perspective views of the clip attachment means 26, according to a preferred embodiment of the present invention, is herein disclosed. The clip attachment means 26 preferably comprises a claw clip-type device attachable at various positions along the outer sheathing of the electrical wiring 28 for removable attachment of the device 10 to various desired locations on the tree branch 32.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 2.

The method of utilizing the device 10 may be achieved by performing the following steps: selecting the shortest sized individual light strands 20 for the upper portions of a tree; placing each of the individual light strands 20 onto each of the tree branches 32; using the clip attachment means 26 to securely attach the individual light strands 20 to the tree branches 32; lifting gently on the individual light strands 20 to feel if it is secured to the tree branches 32; selecting longer individual light strands 20 for the lower portions of a tree; connecting the electrical plugs 30 of one device 10 to the electrical plugs 30 of another device 10 to interconnect as many of the devices 10 as needed to cover the entire tree;

connecting the terminal electrical plug 30 into an electrical outlet, thereby providing electrical power thereto the interconnected devices 10; and, illuminating individual light strands 20 therewith said provided power.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An attachable light string device for tree branches, comprising:

a central bus wire comprising an electrical plug on each end to allow for connection of multiple light string devices theretogether and providing power to said device;

a plurality of individual light strands each connected to said central bus wire, each comprising:

a plurality of light bulbs arranged to outline said tree branches; and, a plurality of electrical wiring connecting said plurality of light bulbs to said central bus wire; and, at least one (1) claw clip attachment means to secure said plurality of individual light strands thereto said tree branches;

wherein said claw clip attachment means enables said plurality of individual light strands to be secured to said tree branches having varying diameters;

wherein said device decorates all types of said tree branches in a more realistic manner by outlining each of said tree branches; and, wherein said device is capable of completely covering any size tree by interconnecting as many of said multiple light string devices as needed.

2. The device of claim 1, wherein a first claw clip attachment means is located adjacent thereto an outer end of each of said individual light strands and a second claw clip attachment means is located adjacent thereto an inner end of each of said individual light strands.

3. The device of claim 1, comprising approximately five (5) to ten (10) individual light strands.

4. The device of claim 1, wherein each of said plurality of individual light strands comprises approximately ten (10) to twenty (20) light bulbs.

5. The device of claim 1, wherein said plurality of electrical wiring is green or white.

6. The device of claim 1, wherein said plurality of light bulbs are light-emitting diodes.

7. The device of claim 1, wherein said plurality of light bulbs are available in a variety of shapes, sizes, and colors.

8. The device of claim 1, wherein said plurality of light bulbs are special effect lights that flash on and off.

9. The device of claim 1, wherein said plurality of individual light strands are available in a variety of lengths to accommodate different sized trees.

10. The device of claim 1, wherein said electrical plug is a male and female electrical plug.

11. The device of claim 1, wherein said electrical plug at one (1) end is plugged into a wall outlet to provide electrical power to said device.

12. The device of claim 1, wherein each of said individual light strands further comprises a vertical light bulb located at an outer end wherein an ornament can sit on top of said vertical light bulb and be illuminated.

13. A method for using an attachable light string device for tree branches, said method comprising the steps of:

providing said device, comprising:

a central bus wire comprising an electrical plug on each end to allow for connection of multiple light string devices theretogether and providing power to said device;

a plurality of individual light strands each connected to said central bus wire, each comprising:

a plurality of light bulbs arranged to outline said tree branches; and, a plurality of electrical wiring connecting said plurality of light bulbs to said central bus wire; and, at least one (1) claw clip attachment means to secure said plurality of individual light strands thereto said tree branches;

wherein said claw clip attachment means enables said plurality of individual light strands to be secured to said tree branches having varying diameters;

wherein said device decorates all types of said tree branches in a more realistic manner by outlining each of said tree branches; and, wherein said device is capable of completely covering any size tree by interconnecting as many of said multiple light string devices as needed;

selecting a shorter size of said plurality of individual light strands for an upper portion of a tree;

placing each of said plurality of individual light strands onto each of said tree branches;

using said claw clip attachment means to securely attach said plurality of individual light strands to said tree branches;

lifting gently on said plurality of individual light strands to feel if it is secured to said tree branches;

selecting a longer size of said plurality of individual light strands for a lower portion of said tree;

connecting said electrical plug of said device to said electrical plug of another said device to interconnect as many of said multiple light string devices as needed to cover entire said tree;

connecting a terminal electrical plug into an electrical outlet, thereby providing electrical power thereto said interconnected multiple light string devices; and, illuminating said plurality of individual light strands therewith said provided electrical power.

14. An attachable light string device for tree branches, comprising:

a central bus wire comprising an electrical plug on each end to allow for connection of multiple light string devices theretogether and providing power to said device;

a plurality of individual light strands each connected to said central bus wire, each comprising:

a plurality of light bulbs arranged to outline said tree branches; and, a plurality of electrical wiring connecting said plurality of light bulbs to said central bus wire; and, at least (1) claw clip attachment means to secure said plurality of individual light strands thereto said tree branches;

wherein said claw clip attachment means enables said plurality of individual light strands to be secured to said tree branches having varying diameters;

wherein said device decorates all types of said tree branches in a more realistic manner by outlining each of said tree branches;

wherein said device is capable of completely covering any size tree by interconnecting as many of said multiple light string devices as needed;

wherein said device has approximately five (5) to ten (10) individual light strands; and, wherein each of said plurality of individual light strands comprises approximately ten (10) to twenty (20) light bulbs.

15. The device of claim 14, wherein a first claw clip attachment means is located adjacent thereto an outer end of each of said individual light strands and a second claw clip attachment means is located adjacent thereto an inner end of each of said individual light strands.

16. The device of claim 15, wherein said plurality of light bulbs are available in a variety of shapes, sizes, and colors.

* * * * *